US006491567B2

(12) United States Patent
Chan

(10) Patent No.: US 6,491,567 B2
(45) Date of Patent: Dec. 10, 2002

(54) CONTRACTILE TOY STRUCTURE

(76) Inventor: Po Wing Chan, Unit 5, 7F, Block 2, Nan Fung Industrial City, No. 18, Tin Hua Road, Tuen Mun, N.T. (HK)

( * ) Notice: Subject to any disclaimer, the term of this patent is extended or adjusted under 35 U.S.C. 154(b) by 0 days.

(21) Appl. No.: 09/776,835

(22) Filed: Feb. 6, 2001

(65) Prior Publication Data

US 2002/0106962 A1 Aug. 8, 2002

(51) Int. Cl.[7] ..... A63H 33/00; A63H 3/52

(52) U.S. Cl. ..... 446/478; 446/320; 446/367; 446/476; 446/487; 446/71

(58) Field of Search ..... 446/268, 320, 446/330, 331, 365, 366, 367, 476, 478, 486, 487, 489; 40/610, 601

(56) References Cited

U.S. PATENT DOCUMENTS 4,992,072 A * 2/1991 Leigh ..... 446/308
5,222,738 A * 6/1993 Muller ..... 273/142 H
5,727,947 A * 3/1998 Esterle ..... 434/258
6,322,421 B1 * 11/2001 Hou ..... 446/219
6,331,147 B1 * 12/2001 Munro et al. ..... 446/478

* cited by examiner

*Primary Examiner*—Jacob K. Ackun
*Assistant Examiner*—Faye Francis
(74) *Attorney, Agent, or Firm*—Rosenberg, Klein & Lee

(57) ABSTRACT

The present invention disclosed a contractile toy structure having a building or figure bodily shape. The toy structure according to the invention comprises one or more sets of resilient supporting mechanisms and a plurality of lock mechanisms. The resilient supporting mechanism makes the toy structure contractile and the lock mechanism holds the toy in a contracted state after the resilient supporting mechanisms are compressed. Through changes between contracted and extended states, the toy can display different postures. In addition, the invention has the advantage of reduced space requirement in transportation due to its contractility that has an effect similar to a foldable or compressible characteristic and thus provides convenience in use.

3 Claims, 6 Drawing Sheets

CONTRACTILE TOY STRUCTURE

BACKGROUND OF THE INVENTION

Toys having bodily shapes are generally divided into two types, solid and hollow. Toys having a solid body are usually small in volume. They can not be big in size due to concerns in weight and cost. On the contrary, toys having a hollow body can be large in size. However, it brings another problem, a large space required for transportation. The quantity of toys accommodated in a fixed space is in inverse proportion to toys' volume. As a result, the delivery cost significantly increases. Thus such conventional toy structures do not meet economic and practical demands.

In view of the above problems, the present invention primarily provides a contractile toy structure that uses resilient supporting mechanisms operatively coupled with lock mechanisms to reduce bodily volume and restore to its original size to provide convenience for transportation.

BRIEF DESCRIPTION OF ACCOMPANYING DRAWINGS

Figure 1:
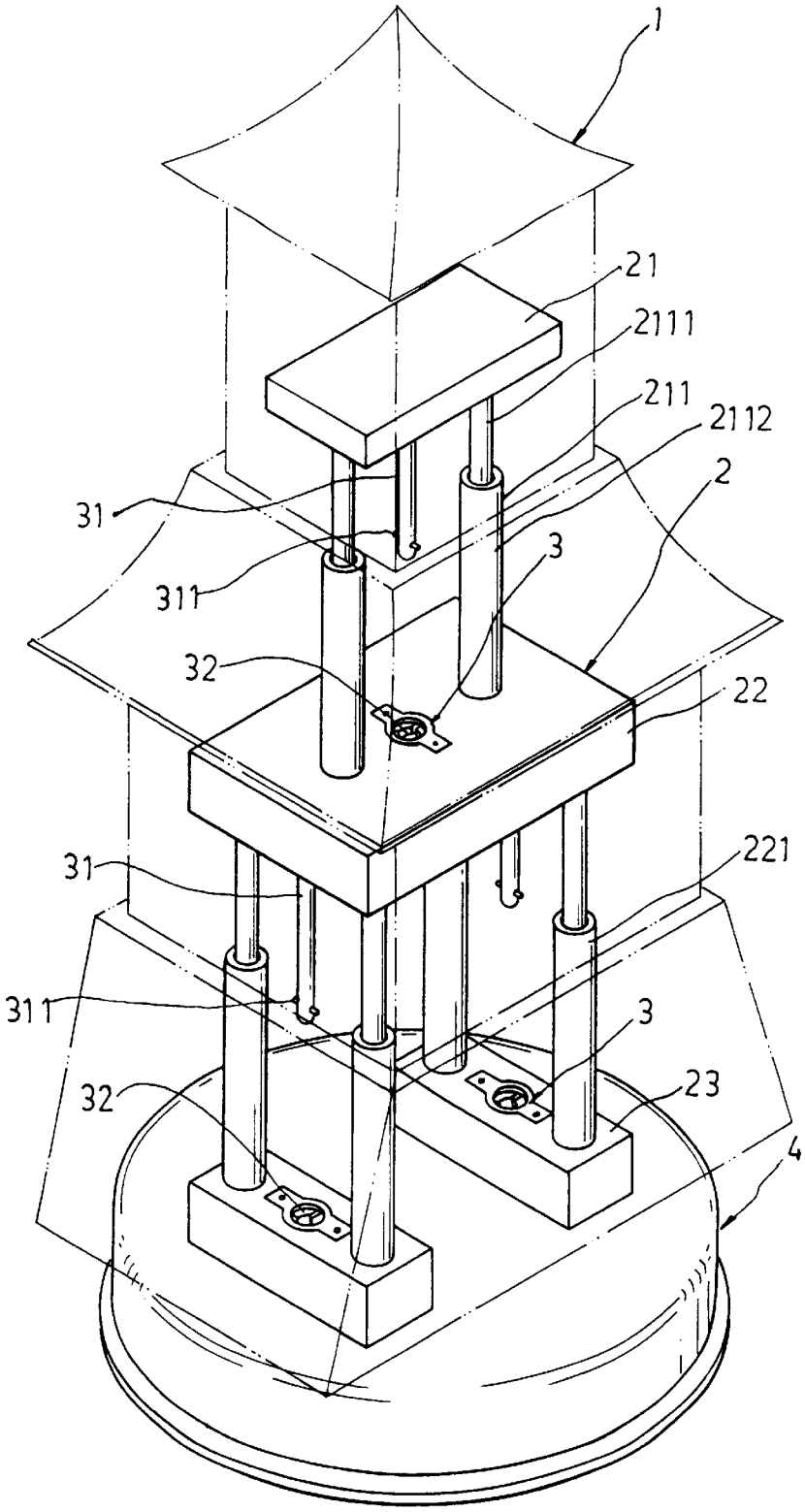
FIG. 1 is a perspective view showing the outer appearance of a toy structure according to the invention.
Figure 2:
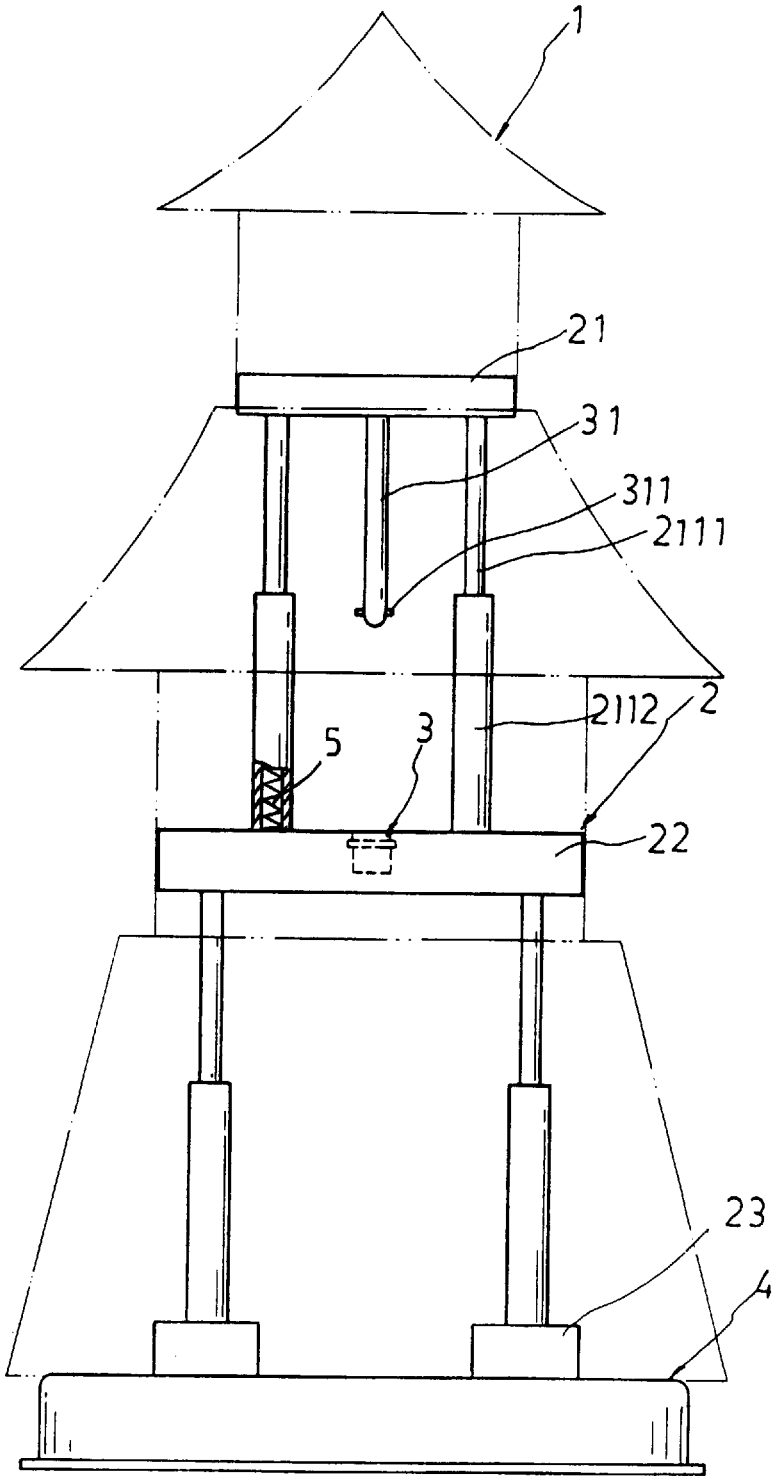
FIG. 2 is an elevated side view of the toy structure in an extended state.
Figure 3:
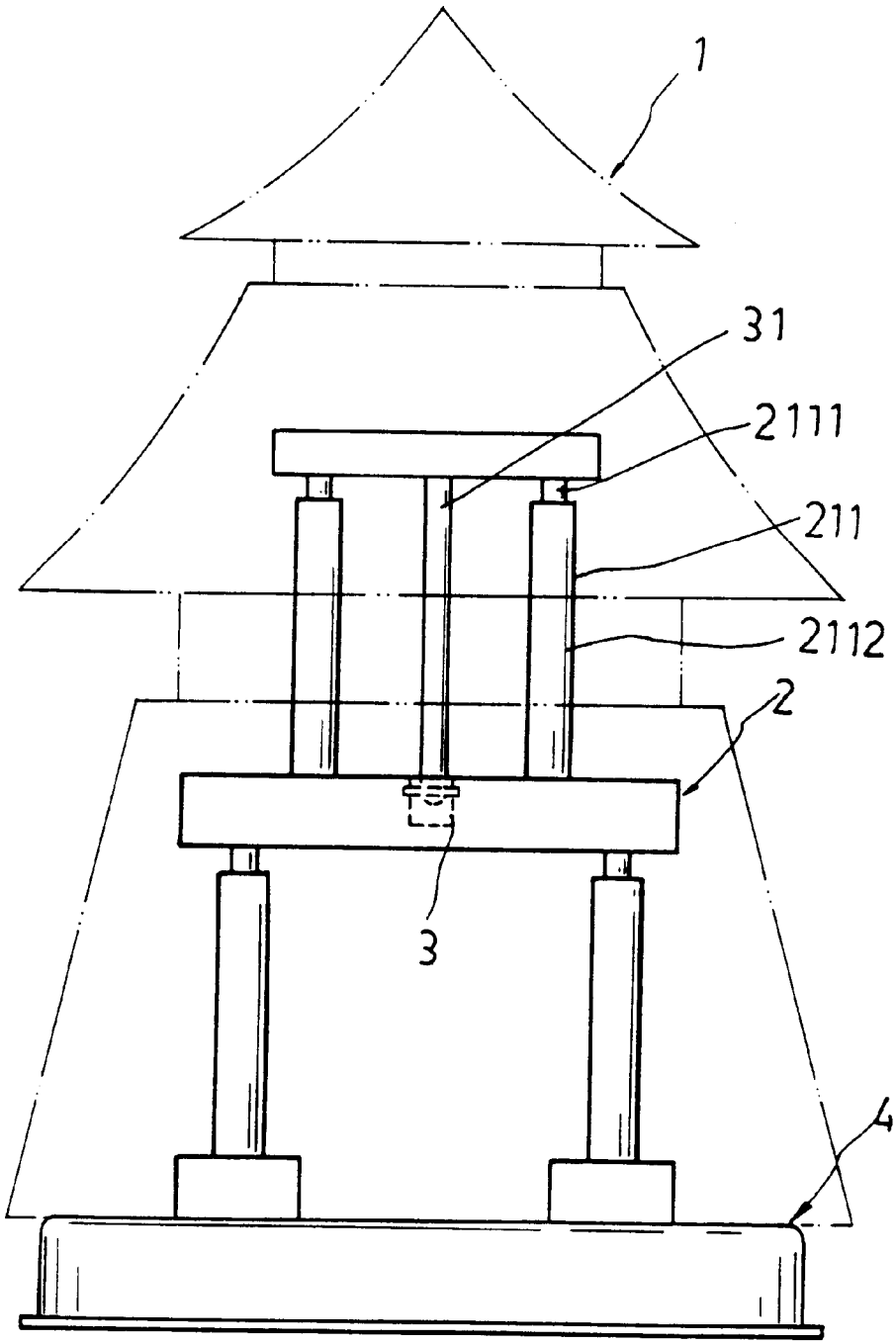
FIG. 3 is an elevated side view of the toy structure in a compressed state.
Figure 4:
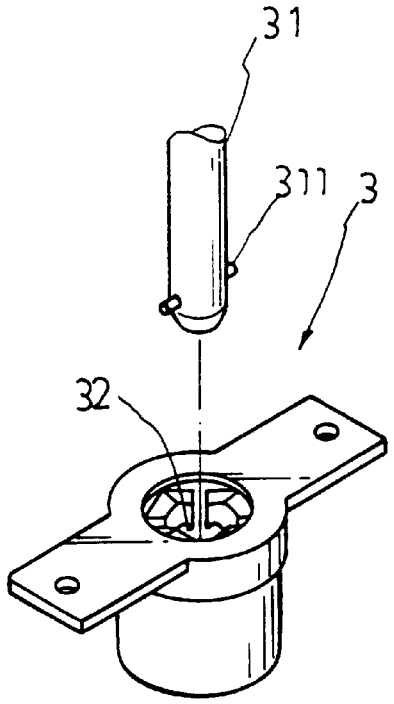
FIG. 4 is a perspective view showing the lock mechanism according to the present invention.
Figure 5:
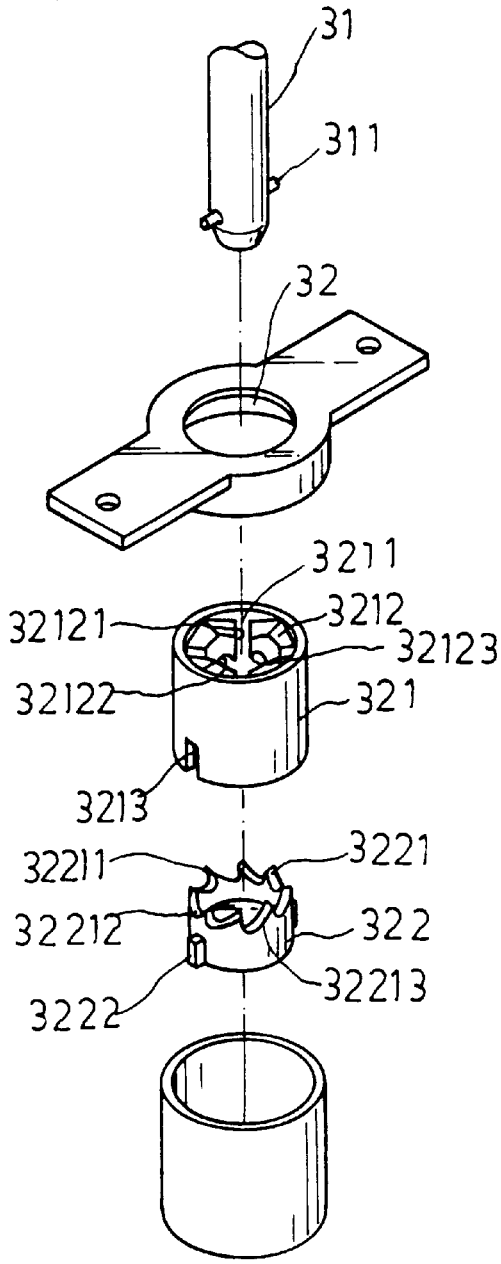
FIG. 5 is an exploded view further illustrating the parts of the lock mechanism of the invention.
Figure 6C:
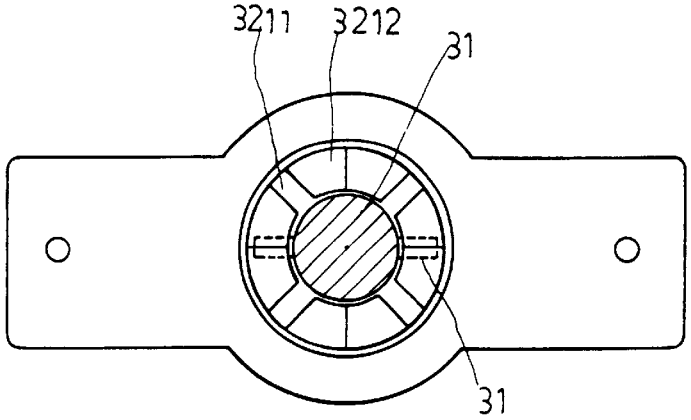
Figure 6A:
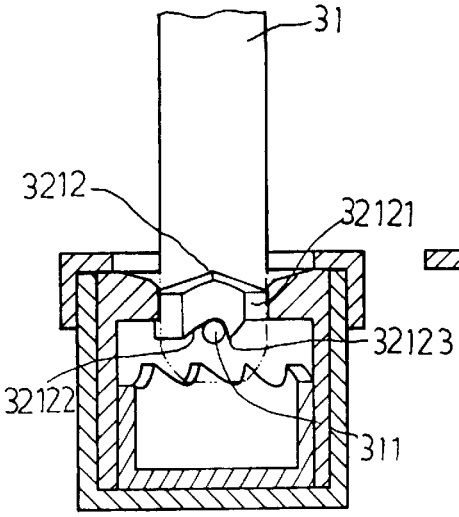
Figure 6B:
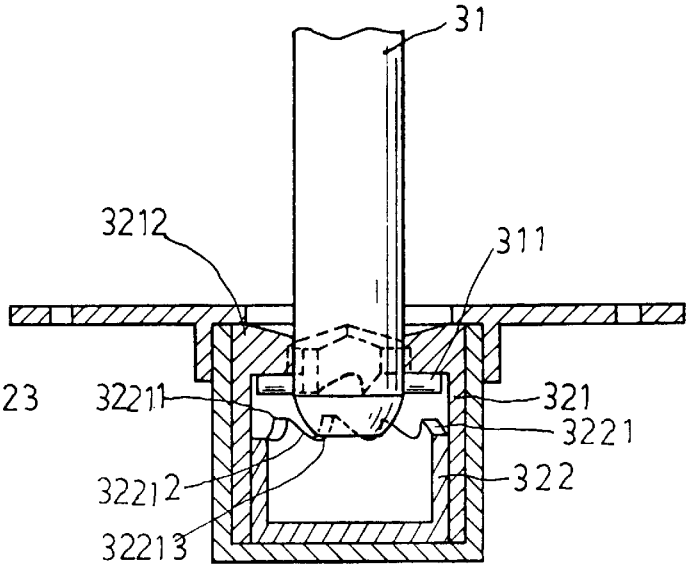

FIGS. 6-A through 6-C schematically show the working principle of the lock mechanism when a toy according to the invention is depressed to its compressed state.

Figure 7C:
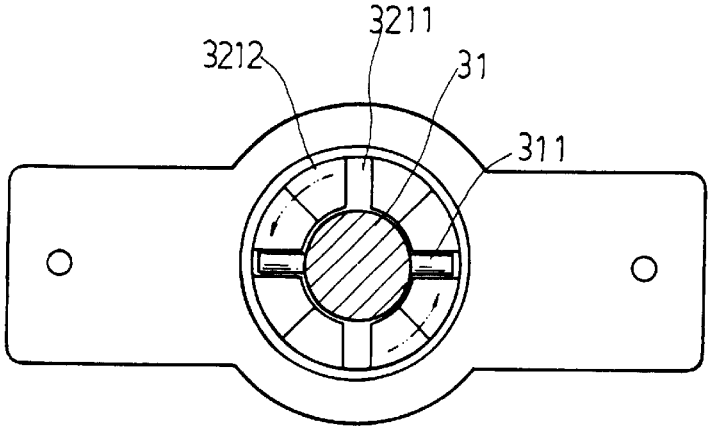
Figure 7B:
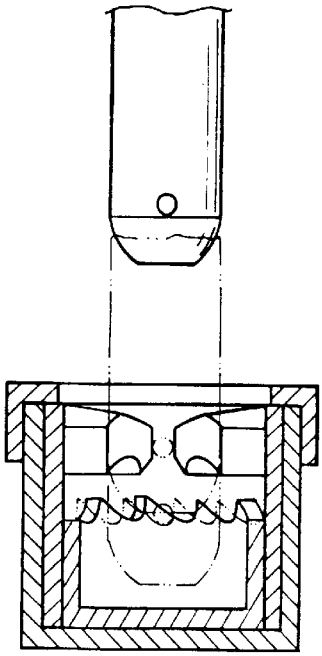
Figure 7A:
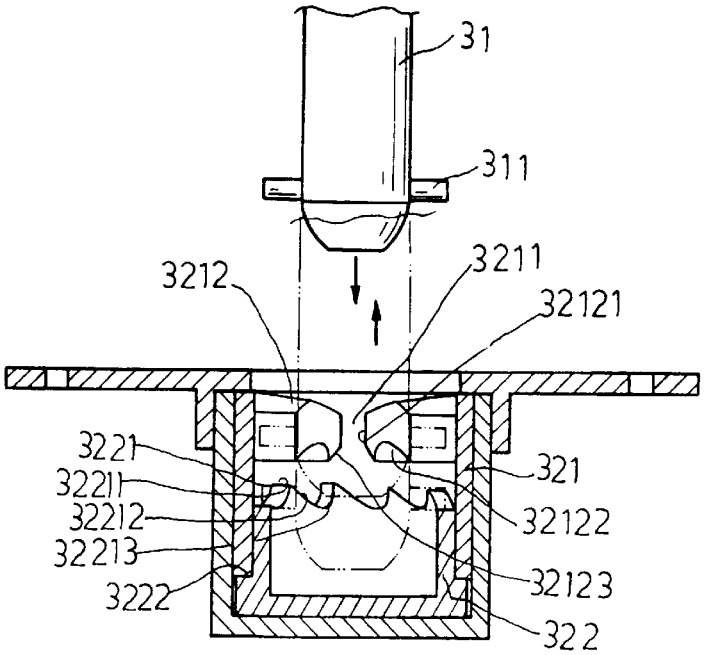

FIGS. 7-A through 7-C schematically show the working principle of the lock mechanism when the toy is released from its compressed state.

DETAILED DESCRIPTION OF THE INVENTION

Now referring to accompanying drawings, an embodiment of the toy according to the present invention comprises a flexible housing (1), a resilient supporting mechanism (2), a lock mechanism (3), and a base (4). The flexible housing (1) and the base (4) can be configured at will to have desired shapes. The compressible or foldable portion of the housing (1) is made of flexible material. The resilient supporting mechanism (2) is composed of supporting plates (21, 22, 23) that provide support to the flexible housing (1) and are supported by the base (4). These supporting plates (21, 22, and 23) are linked in series by means of retractable tube sets (211, 221) that provide the supporting mechanism (2) with a compressible and extending feature. The retractable tube set (211) consists of a rod (2111) attached to the bottom surface of the support plate (21) and slidably seated in a tube (2112). A spring 5 is disposed under the rod (2112) and housed in the tube (2112) to provide resilient forces.

To delimit the contraction of the resilient toy structure, a lock rod (31) of a decent length is disposed on the bottom face of the supporting plate (21). The lock rod is provided near the lower end with a stud (311) on two opposite sides. Disposed on the top face of the supporting plate (22) is a recess at a position corresponding to the lock rod (31). In the recess there is a first lock block (321) that is pivotally held by a ring plate (32). The first lock block (321) has a hollow cylindrical form and is provided along the inner circumference of the top end thereof with a plurality of spaced ratchet teeth (3212). There is a decent space (3211) interposed between each pair of adjacent ratchet teeth (3212). Each ratchet tooth (3212) is configured to have at its outer ends a vertical surface (32121) that extends downwardly to an inwardly inclined surface (32122) and that ends up with a protrusion (32123), and a top surface (32124) consisting of a raised central portion and two downwardly inclined side portions. The space (3211), defined by two opposite vertical surface (32121) and protrusions (32123) on its two sides, is adapted to be slightly larger than the diameter of a stud (311). Furthermore, the first lock block (321) is provided with a plurality of slots (3213) at its lower end.

The second lock block (322) is a tube with a closed lower end. The top end surface of the block (322) is provided with a consecutive ratchet portion made up of a plurality of ratchet teeth (3221). Each ratchet tooth (3221) comprises a tooth crest (32211), a tooth valley (32212), and tooth shoulders (32213). The second lock block (322) is further provided on its lower end with protrusions (3222) at positions corresponding to the slots (3213) of the first lock block (321). Thus, when the first lock block (321) is seated in the interior of the second lock block (322), the protrusions (3222) engage with the slots (3213), with each space (3211) aligned with a tooth shoulder (32213).

When in use, with the aid of the resilient supporting mechanism (2), the supporting plates (21, 22, and 23), and the retractable tube sets (221, 222), the toy structure of the invention is normally in its extended position. To contract the toy for transportation, users depress the housing (1) to make the supporting plates (21, 22) together with the lock rod (31) to descend. With the guidance of the inclined side portions of the top surface (32124), the studs (311) of the lock rod (31) can smoothly pass through the space (3211) and then, by means of the tooth shoulder (32213) of the second lock block (322), respectively fall into a tooth valley (32212). At that time, users release the depression to let the studs (311) press against the arched recess of the protrusions (32123) of the first lock block (321) by means of a biasing spring force. In this way the contraction operation is completed and the needed transportation space is significantly reduced. To restore its natural height, users just depress the housing (1) in the same manner as the one described above. The depression action is delivered through the same mechanism as the one in the contraction operation to make studs (311) descend to escape from the recess of the protrusion (32123). By means of the guidance of the tooth shoulders (32213) and the pivotal motion of the lock blocks (321, 322), the stud (311) will be in alignment with one of the spaces (3211). As a result, once users release the depression of the housing (1), studs (311) ascend to pass through the spaces (3211) and the housing (1) returns to its original height.

From the above description, the invention uses an ingenious combined mechanism to make a toy structure able to be contracted in a quick and simple way to achieve the goals set forth in the beginning of the text. It is a technical advance and has practical value in industry. Evidently the invention meets the requirements of granting a patent. We hereby apply for a patent grant.

What is claimed is:

1. A contractile toy structure, comprising:

a flexible housing having a contractible portion composed of a flexible material;

a resilient supporting mechanism composed of a plurality of supporting plates having a top supporting plate and a plurality of intermediate supporting plates to support said flexible housing and a plurality of retractable tube sets, each of said intermediate supporting plates having at least one recess positioned on a top surface thereof and linked in series by said retractable tube sets, each of said retractable tube sets defining a tube, a rod and a spring, said rod having a first end attached to a bottom surface of an upper supporting plate and a second end slidably accommodated in said tube fixedly secured to a lower intermediate supporting plate; said spring being located within said tube and bearing against said rod and said intermediate supporting plate on opposing ends thereof;

a base for supporting said supporting plates; and, a lock mechanism having a lock rod attached to a bottom surface of said upper supporting plate and a pair of lock blocks defining a first lock block and a second lock block, said lock rod having a stud projecting outwardly on two opposing sides at a lower portion thereof, each of said lock blocks located within said at least one recess of an intermediate lower supporting plate, each of said lock blocks positioned below said upper supporting plate for receiving said lock rod, said first lock block being rotatably mounted in a ring plate, said first lock block having a plurality of spaced ratchet teeth defining spaces between said ratchet teeth and a plurality of slots formed in a wall of said first lock block, each of said ratchet teeth being inclined downwardly to an inwardly inclined surface forming protrusions and a top surface having a raised central portion and two downwardly inclined side portions, said second lock block being a tube with a closed lower end and having a plurality of ratchet teeth and protrusions extending from a sidewall thereof, each of said ratchet teeth having a tooth crest, a tooth valley and tooth shoulders, said protrusions positioned at a lower end of said second lock block and respectively corresponding to said slots of said first lock block such that said second lock block is inserted into an interior of said first lock block and said protrusions of second lock block engage within said slots of said first lock block with each of said spaces aligned with said tooth shoulder in order to form a pivotal lock unit for said lock blocks to rotate around a central axis.

2. The contractile toy structure as recited in claim 1, wherein said resilient supporting mechanism contains more than two supporting plates, each of said supporting plates having a predetermined contour.

3. The contractile toy structure as recited in claim 1, wherein said plurality of retractable tube sets are vertically displaced each from the other.

* * * * *